United States Patent [19]

James

[11] Patent Number: 4,597,554

[45] Date of Patent: Jul. 1, 1986

[54] WALL POSITIONING DEVICE

[76] Inventor: Houston F. James, 8350 Mobberly, Dallas, Tex. 75227

[21] Appl. No.: 547,044

[22] Filed: Oct. 31, 1983

[51] Int. Cl.[4] ..... F16M 13/00

[52] U.S. Cl. ..... 248/542; 40/152.1; 40/617; 248/467

[58] Field of Search ..... 248/489, 494, 495, 496, 248/542, 220.2, 222.1, 224.3, 466, 467, 475.1; 40/152.1, 617, 621; D8/373, 349

[56] References Cited

U.S. PATENT DOCUMENTS

| | | | |
|---|---|---|---|
| 3,112,912 | 12/1963 | Alvarez | 248/496 |
| 3,165,287 | 1/1965 | Parsons | 248/496 |
| 3,294,355 | 12/1966 | Topf | 248/489 |
| 3,612,469 | 10/1971 | Dennis | 248/475.1 |
| 4,083,525 | 4/1978 | Rath | 248/496 |
| 4,228,982 | 10/1980 | Sellera | 248/467 |

*Primary Examiner*—Ramon S. Britts
*Assistant Examiner*—Ramon O. Ramirez
*Attorney, Agent, or Firm*—T. D. Copeland

[57] ABSTRACT

A wall positioning device comprising a mounting set for hanging a display board, or picture, or the like, from a wall or other vertical surface support, wherein the display board or picture is assured to be hung straight and level, and yet may be easily removed or replaced by another board having a matching hanger piece, whereby the second hung picture will a also be straight and level. The technique used in this hanger mounting set involves a projecting tab on the hanger piece a attached to the board or picture, and a receiving notch on the other hanger piece that is attached to the wall, wherein each of the two pieces incorporates a small spirit level that may remain permanently as a part of that piece, or be removed after installation as desired. The matching notch and tab are each located on horizontal members that engage simultaneously with said notch and tab, and prevent any angularity in their engagement, once the tab engages the notch.

3 Claims, 4 Drawing Figures

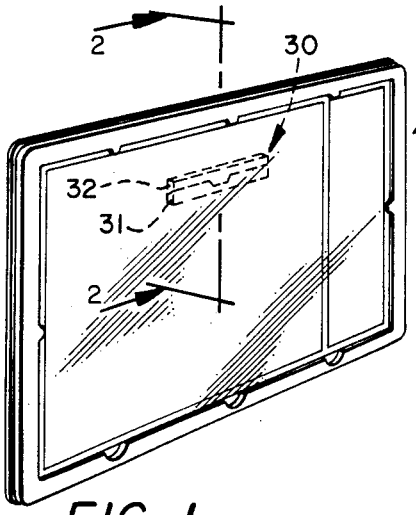
FIG. 1
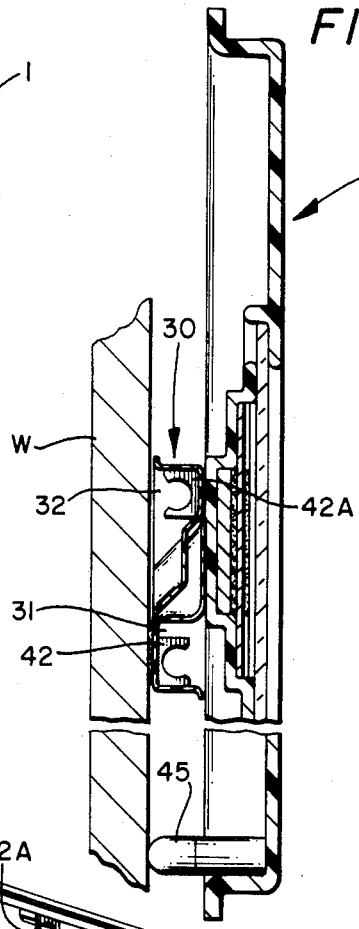
FIG. 2
FIG. 3
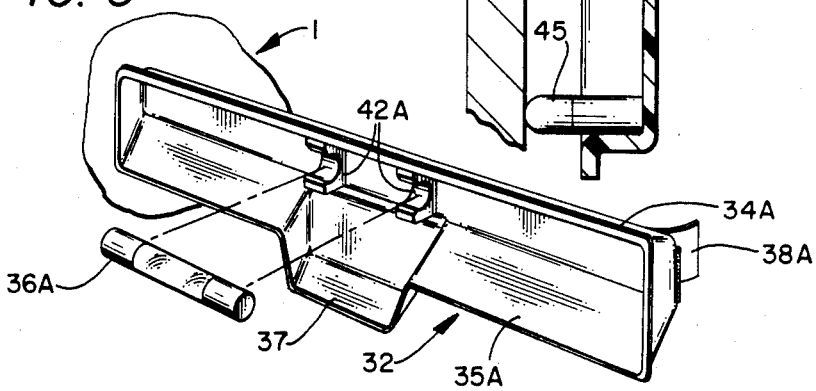
FIG. 4
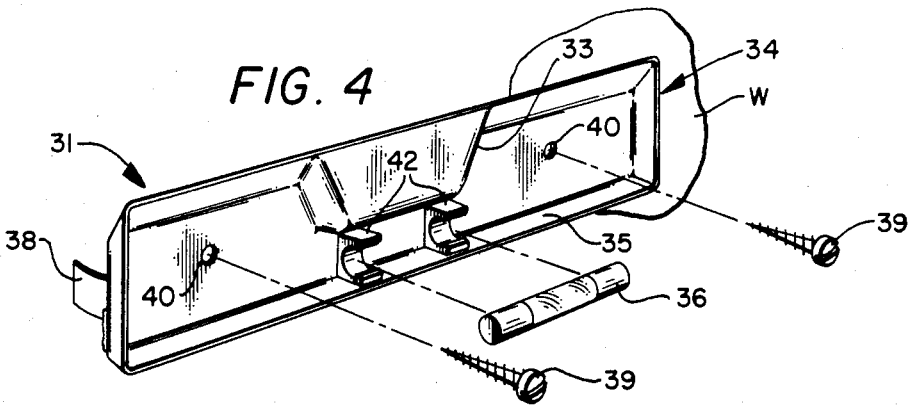

WALL POSITIONING DEVICE

BACKGROUND OF THE INVENTION

There have been many attempts in the prior art to devise a fixture for accurately mounting pictures and the like on walls. The basic nail and wire structure is one example of a mounting arrangement that permits levelling of a picture when mounting same to a wall. But this technique is at best a temporary expedient, since pictures hung by this construction must be constantly monitored and readjusted from time to time to maintain the desired appearance of being level relative to its surroundings.

This application is copending with my design application filed on the same date hereof, and also entitled "Wall Positioning Device", and with my product patent application, filed of even date, and entitled "Quick-Change Plastic Strip Display Board", and with my second design application filed on the same date. All such applications having similar or related subject matter, are all incorporated herein by reference.

SUMMARY OF THE INVENTION

The instant invention comprises a set of parts, one of which is mounted to a wall or desired vertical support in a precisely level attitude and the second of which is mounted to a display board or the like in a precisely level attitude. The wall mounted part includes a recessed notch or pocket of a particular configuration from an angularly inclined but precisely horizontally mounted top surface; whereas the board mounted part includes a downwardly projecting tab of a similar configuration to the notch, whereby at installation, the tab may be moved alont the horizontal surface until the tab finds the notch, whereupon said tab and notch engage in relatively tight fitting manner, which insures the precise locating of the display board or picture on the wall. Each part includes a quick mounting device to hold a small spirit level to insure that each part is mounted in a perfectly horizontal and level attitude, which cannot under normal usage become misaligned as is quite common when display boards are hung on a wall by conventional means.

BRIEF DESCRIPTION OF THE DRAWING

FIG. 1 is a perspective view of the wall positioning device of this invention in use.

FIG. 2 is a cross-section view taken along the line 2—2 of FIG. 1.

FIG. 3 is a perspective view of the board mounting fixture of the device of FIGS. 1 and 2.

FIG. 4 is a perspective view of the wall mounting fixture of the device of FIGS. 1 and 2.

DESCRIPTION OF THE PREFERRED EMBODIMENT

The wall positioning device of this invention is used to hang a display board or picture, or similar article, as indicated in FIGS. 1 and 2. Such article may be hung from a wall or other support location by the unique mounting set 30, comprising a wall mounting fixture 31 and a board mounting fixture 32, as seen in FIGS. 1–4. The wall mounting fixture 31 is seen to comprise a molded or extruded plastic member of relatively thin walls that includes a centrally located pocket or notch 33, and a short dimension peripheral flange 34 including a bottom ledge 35 that provides partial support for mounting clips 42 for a very small spirit level 36. The board mounted fixture 32 is constructed similarly to fixture 31, but includes instead a centrally located tab 37 that extends downward from the fixture 32, and is of corresponding dimensions to those of pocket 33. Fixture 32 also includes a peripherial flange 34A including a top ledge that provides partial support for the clips 42A that hold a second small spirit level 36A. Each fixture 31 and 32 may include an adhesive tape 38/38A on its back side, or may include screws 39 and screw hole 40, to permit these fixtures to be mounted to the wall and display board selectively. Once the spirit level of each fixture is installed it its slightly flexible clip, and shows its fixture to be level, the fixtures are then mounted at that position. Thereafter, regardless of the number of times the display board assembly 1 is removed from the wall W, it may be re-mounted in its established level position. It should be noted that the spirit levels are so mounted that they do not interfere with the cooperative engagement of the fixtures 31 and 32, nor of the attachment of these fixtures to the wall or display board assembly, hence one or both of these spirit levels may remain in their installed positions. However, since only one spirit level can be used at a time by a single installer, it may be economical to include only one spirit level per installation packet. In this instance, the installer would mount one part, say fixture 31, and after its installation on the wall W, move the spirit level to fixture 32, and after its installation on the display board, simply leave it in place in its clip, or discard, as desired.

When said display board assembly is installed on a wall as indicated in FIGS. 1 and 2, there may be a tendency for the lower end of board 2 to tilt in toward the wall W, which is undersirable as the board face would then no longer be vertically oriented. To correct this I have installed a rubber tab 45 to provide a stop at the precise point to maintain the board 2 in its desired vertical orientation.

The methods, techniques and structures disclosed and illustrated are representative of, but not limiting to the scope of the invention, as defined in the following claims, and including equivalents thereto.

What is claimed is:

1. In combination with a wall and an article to be mounted thereon, a matched set of a pair of fixture members in a wall positioning device, comprising:

a. a first fixture member having a continuous and relatively long horizontally extending angularly inclined peripherial flange on its lower side with an integrally formed downwardly projecting tab thereon of relatively short horizontal dimension located intermediate the length of said flange, b. a second fixture member having a continuous relatively long horizontally extending angularly inclined peripherial flange on its upper side with an integrally formed upwardly facing pocket of relatively short horizontal dimension located intermediate the length of said flange, c. means for installing said first fixture member to the back side of said article, and means for installing said second fixture member to the front side of said wall, whereby d. said relatively long horizontal flange of said first fixture member engages said long horizontal flange of said second fixture member simultaneously with the engagement of said tab with said pocket in a relatively tight fitting manner preventing any angularity in their engagement.

2. In a pair of fixture members as in claim 1, wherein each fixture member includes quickly insertable and releasable means comprising slightly flexible clips located on said fixture members, and a spirit level of a size to be readily inserted in one of said clips during installation, and then removed and inserted into the clips of the other fixture member.

3. A pair of fixture members as in claim 1, wherein said tab and pocket are each tapered inwardly from top to bottom, and wherein the engagement of said tab and pocket occurs when said tab finds said pocket on being moved along said long horizontal surface of said second fixture to thus provide a simultaneous engagement of said tapered tab and tapered pocket and each long inclined horizontal peripherial surface of each fixture member.

* * * * *